United States Patent [19]

Ohashi et al.

[11] Patent Number: 4,995,601

[45] Date of Patent: Feb. 26, 1991

[54] ANTI-SKEW SHEET FEEDING DEVICE FOR IMAGE FORMING APPARATUS AND SHEET STORAGE DEVICE FOR USE THEREIN

[75] Inventors: Masashi Ohashi, Tokyo; Yoshikuni Toyama, Yokohama; Kazuo Kagiura, Tokyo; Hiroyoshi Maruyama, Yokohama; Tatsuya Shiratori, Kawasaki; Masanari Shirai, Chigasaki; Eiichi Ando, Yokohama, all of Japan

[73] Assignee: Canon Kabushiki Kaisha, Tokyo, Japan

[21] Appl. No.: 288,458

[22] Filed: Dec. 22, 1988

[30] Foreign Application Priority Data

Dec. 28, 1987 [JP] Japan ..... 62-334072
Feb. 20, 1988 [JP] Japan ..... 63-037873

[51] Int. Cl.[5] ..... B65H 1/08
[52] U.S. Cl. ..... 271/127; 271/171
[58] Field of Search ..... 271/22, 21, 171, 164, 271/127, 109, 126, 162; 355/308, 311

[56] References Cited

U.S. PATENT DOCUMENTS 4,037,953 7/1977 Sone et al. ..... 355/45
4,332,375 6/1982 Tsubo ..... 271/127 X
4,632,380 12/1986 Ono ..... 271/127
4,714,243 12/1987 Staniszewski ..... 271/171
4,754,301 6/1988 Kasamura et al. ..... 355/3 DD
4,768,772 9/1988 Ochiai et al. ..... 271/164
4,815,724 3/1989 Sumida et al. ..... 271/127 X
4,823,159 4/1989 Yamamoto et al. ..... 355/3 SH

*Primary Examiner*—R. L. Moses
*Assistant Examiner*—Thu Anh Dang
*Attorney, Agent, or Firm*—Fitzpatrick, Cella, Harper & Scinto

[57] ABSTRACT

A sheet feeding device for use in an image forming apparatus provided with a sheet support plate and one or more rotary members for separating and feeding sheets. A recessed portion is formed on the sheet support plate in a position opposing to each rotary member. A detachable auxiliary member is provided to be fitted in the recess to form a plane coplanar with that of the sheet support plate. An engaging device can be provided, to engage with a step portion formed in a cassette housing portion of the apparatus to keep the cassette from being entirely removed from the housing. The engaging device may, for example, include an elastic part and an engaging part integrally molded with each other.

10 Claims, 10 Drawing Sheets

ANTI-SKEW SHEET FEEDING DEVICE FOR IMAGE FORMING APPARATUS AND SHEET STORAGE DEVICE FOR USE THEREIN

BACKGROUND OF THE INVENTION

1. Field of the Invention

The present invention relates to a sheet feeding device and sheet storage device for use therein, for an image forming apparatus such as a copying machine, printing machine, laser beam printer or the like, and more particularly to an image forming apparatus provided with a box-shaped sheet storage device (hereinafter called "cassette") containing a plurality of sheets.

2. Related Background Art

There is provided therein with a cassette containing a plurality of sheets. As shown in FIGS. 1 and 2, the cassette 1' employed in such image forming apparatus is provided with an inner plate 2' for supporting plural sheets S, and a limiting plate 3 for limiting the lateral movement of said sheets S. Said inner plate 2' is provided with plural elongated holes 4 in the transverse or lateral direction of the sheets, and said limiting plate 3 is so constructed as to be movable in said elongated holes 4 according to the sheet size and to protrude through one of said elongated holes 4. Above the downstream end of said limiting plate 3 there is provided a separating finger 5 for separating the sheets S one by one. At the right side of said inner plate 2' (as seen facing downstream), a side plate 8 is fixed to the bottom plate of the cassette 1', and another separating finger 5 is also provided above the downstream end of said side plate 8. Above said cassette 1' there is rotatably supported a shaft 6 connected to an unrepresented motor and having plural sheet feed rollers 7 corresponding to various sheet sizes. Said inner plate 2' is biased upwards by a spring 9, whereby the sheets S stacked on said inner plate 2' are pressed against the sheet feed rollers 7.

In response to the actuation of an unrepresented start key, the motor is activated to rotate said sheet feed rollers 7, thereby feeding the sheets S. Then, said sheets S are separated one by one by said separating fingers 5 and the uppermost sheet S alone is transported.

However, in a case where narrow sheets S (for example of a width A shown in FIG. 1) are used in the above-explained cassette 1', two sheet feed rollers 7 in the area B may come into direct contact with the inner plate 2', once the number of sheets S on plate 2' has decreased sufficiently, or due to lateral inclination of the inner plate 2' or fluctuation in the precision of the feed rollers 7. Such contact decreases the pressure of the sheet feed rollers 7 in the area A on the sheets S, thus resulting in skewed feeding, overlapped or creases or wrinkles of the sheets S. Also, the rollers 7 in the area B may be abnormally abraded due to friction with the inner plate 2'.

Also in the above-explained conventional image forming apparatus, the cassette 1' may be dropped and damaged when it is extracted from the apparatus for sheet replenishment.

SUMMARY OF THE INVENTION

It is an object of the present invention to eliminate the above-explained drawbacks of the prior technology and to provide a sheet feeding device and a sheet storage device for use therein, capable of secure sheet feeding and preventing the abrasion of the rollers by friction.

Another object of the present invention is to provide a sheet storage device in which the above-mentioned drawbacks are eliminated by substantially achieving absence of contact (including in the term "absence of contact" slight contact or contact with a member of low friction coefficient) between the inner plate and the sheet feed rollers outside the region occupied by the sheet.

According to the present invention, for example in a case where narrow sheets are stacked on the inner plate, the feed rollers outside the region of the sheets are placed in an escape position and are thus prevented from contact with the inner plate, so that the pressure of the feed rollers on the sheet is made uniform, thereby preventing skewed feeding, overlapped advancement, and creases or wrinkles. Besides, because of the absence of contact with the inner plate, the feeding rollers are protected from abnormal abrasion, and the service life thereof can be extended. Also a sufficient effect can be obtained in comparison with the conventional structure, even in the case of light contact or contact with a member of low friction, rather than complete lack of contact.

Also the above-explained sheet storage device is constructed in such a manner that, when it has been extracted almost all the way from the main body of the image forming apparatus, an engaging member engages with a step portion of said main body whereby the sheet storage device cannot be extracted completely. In this manner, the dropping of the sheet storage device can be prevented.

DESCRIPTION OF THE PREFERRED EMBODIMENTS

Now the present invention will be clarified, non-limitatively, by description of the preferred embodiments thereof, shown in the attached drawings.

Figure 1:
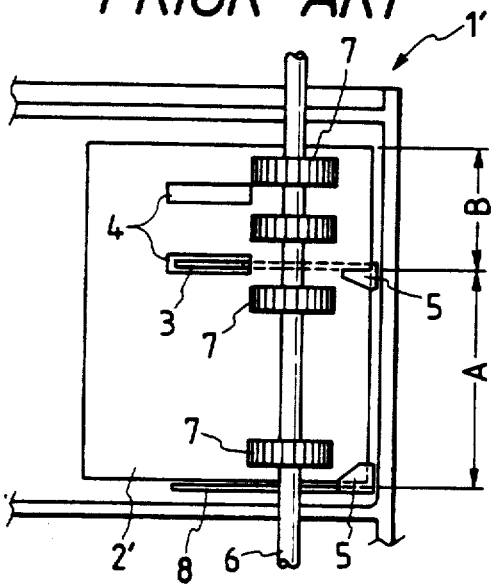
FIG. 1 PRIOR ART
FIG. 1 is a plan view of a conventional structure.
Figure 2:
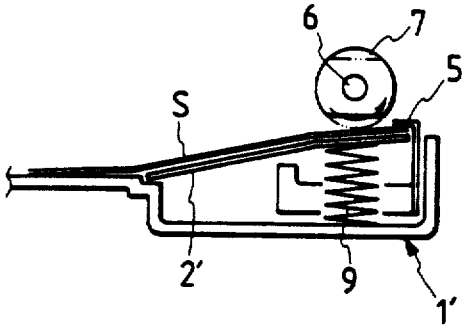
FIG. 2 PRIOR ART
FIG. 2 is a lateral cross-sectional view thereof.

In the following description, components corresponding to those in the conventional structures shown in FIGS. 1 or 2 will be represented by the same numbers and will not be explained anew.

Figure 3:
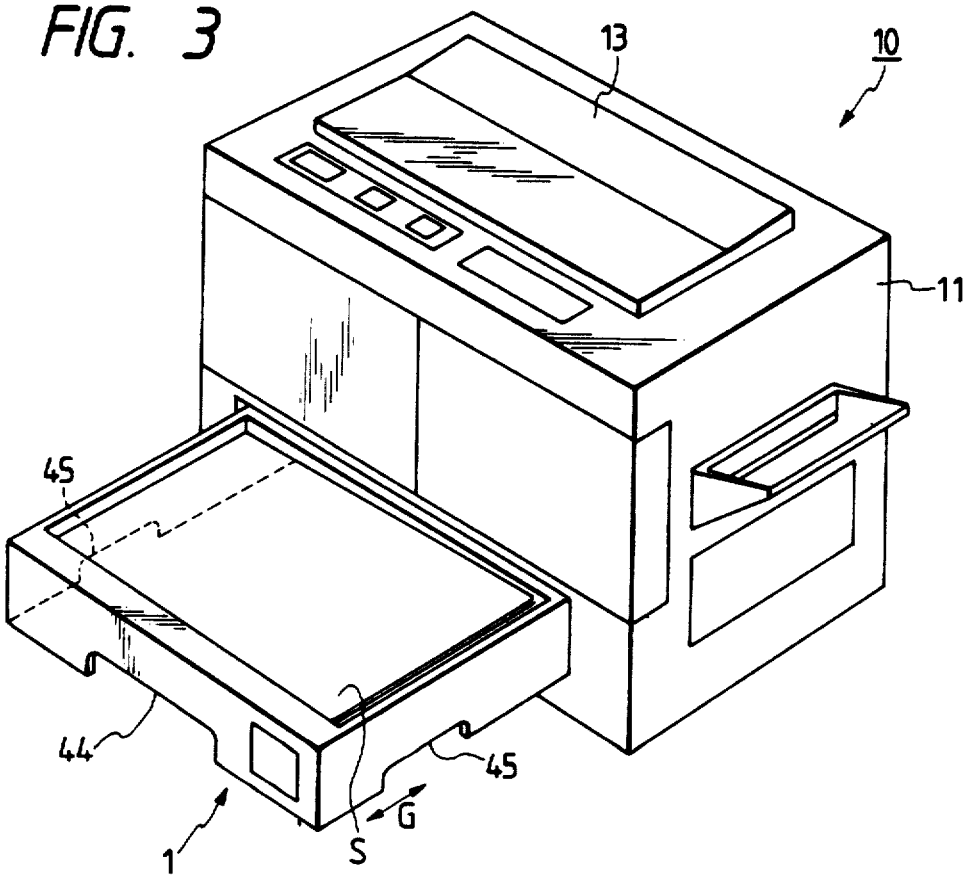
FIG. 3 is an external perspective view of an image forming apparatus of front loading type provided with a sheet storage device (cassette) of the present invention, in which said cassette is loaded or extracted through a front face of the apparatus.
Figure 4:
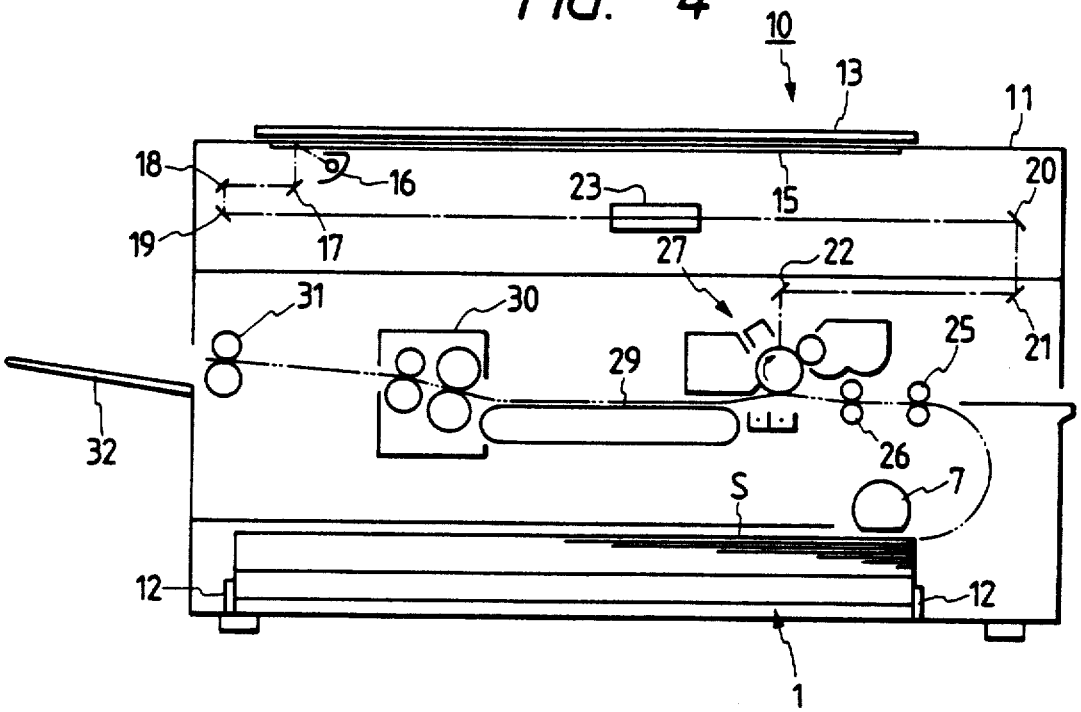
FIG. 4 is a frontal cross-sectional view of said image forming apparatus.

As shown in FIGS. 3 and 4, the cassette 1 is detachably loaded in a body 11 of a copying machine 10, and is made extractable, as shown in FIG. 3, along guides 12 in a direction perpendicular to the sheet transporting direction. In said body 11 there are provided a pressure plate 13; a platen 15; a light source 16; mirrors 17, 18, 19, 20, 21, and 22; and a lens 23. In the downstream side of said cassette 1 there are provided paired transport rollers 25 and paired registration rollers 26. At the downstream side of said rollers, there are provided, in succession, an image forming station 27; a conveyor belt 29; a fixing unit 30; paired discharge rollers 31; and a discharged sheet tray 32.

Figure 5:
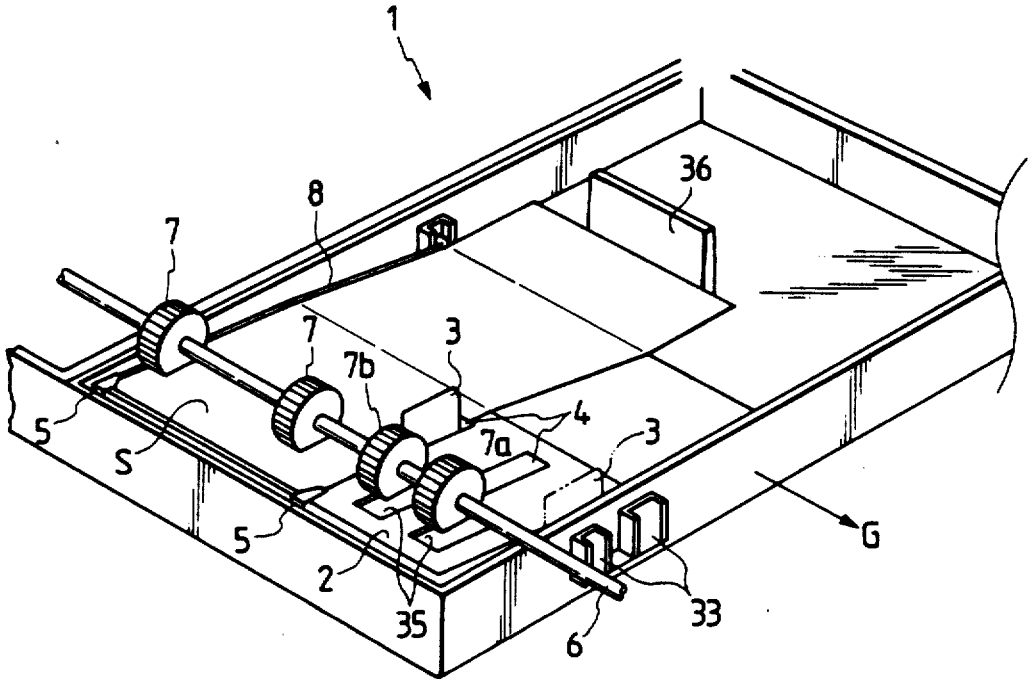
FIG. 5 is a perspective view showing the sheet feeding device of said image forming apparatus

The cassette 1 has a structure shown in FIG. 5, wherein the inner plate 2 is provided with recesses 35 constituting escape portions, corresponding to third and fourth sheet feed rollers 7*a*, 7*b*, counted from the sheet feed roller at the right side of the sheet feeding direction (the roller positioned at the upper left in the drawing). Therefore, in a case of using narrow sheets S not reaching said feed rollers 7*a*, 7*b*, said rollers are prevented from contact with the inner plate 2. A limiting plate 36 for limiting the rearward movement of the sheets S can be mounted on holes 40 formed o the cassette 1 corresponding to various sheet sizes or holes 41 for limiting the rearward movement of the sheets S in the longitudinally oblong position.

Figure 8:
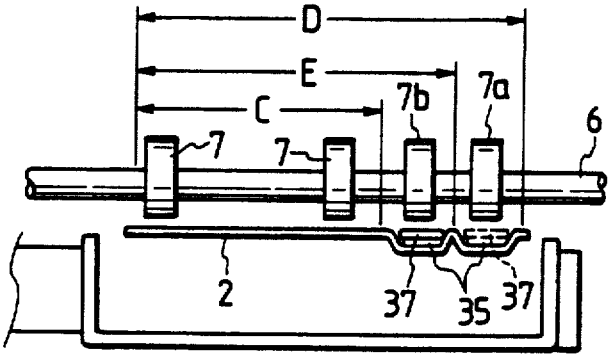
FIG. 8 is a lateral view of the sheet feeding device of the image forming apparatus.
Figure 9:
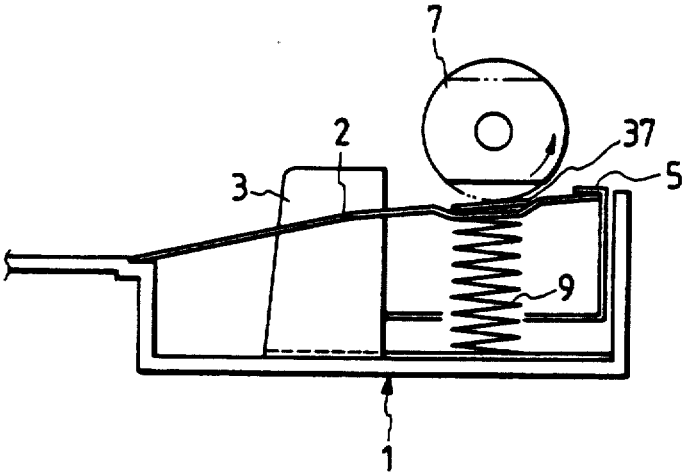
FIG. 9 is a front view thereof.

On the other hand, if the sheets S are extended to said feed rollers 7*a*, 7*b*, flexible auxiliary members 37 can be fitted into said recesses 35 to constitute a planar surface with the inner plate 2 as shown in FIGS. 8 to 10, so that the sheet feed rollers 7*a*, 7*b* can provide sufficient pressure on the sheets S.

Figure 10A:
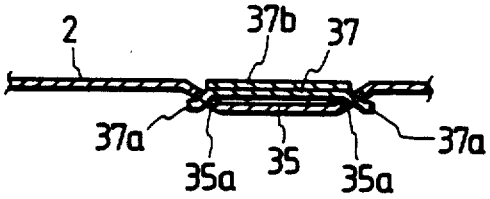
FIG. 10A is a frontal cross-sectional view of an auxiliary member of the inner plate of the cassette.
Figure 10B:
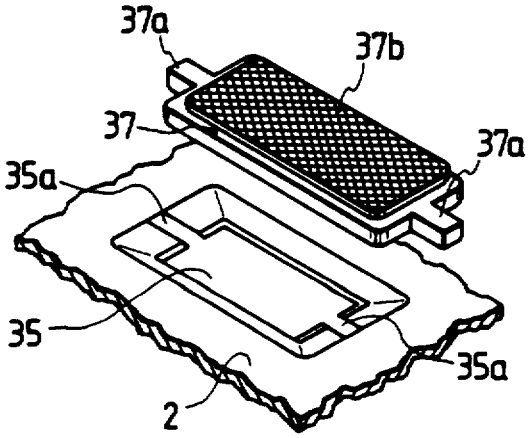
FIG. 10B is an exploded perspective view thereof.

As shown in FIGS. 10A and 10B, said auxiliary member 37 is provided, on both ends thereof, with pins 37*a* and is supported by insertion thereof into slits 35*a* formed in the recess 35.

Figure 6:
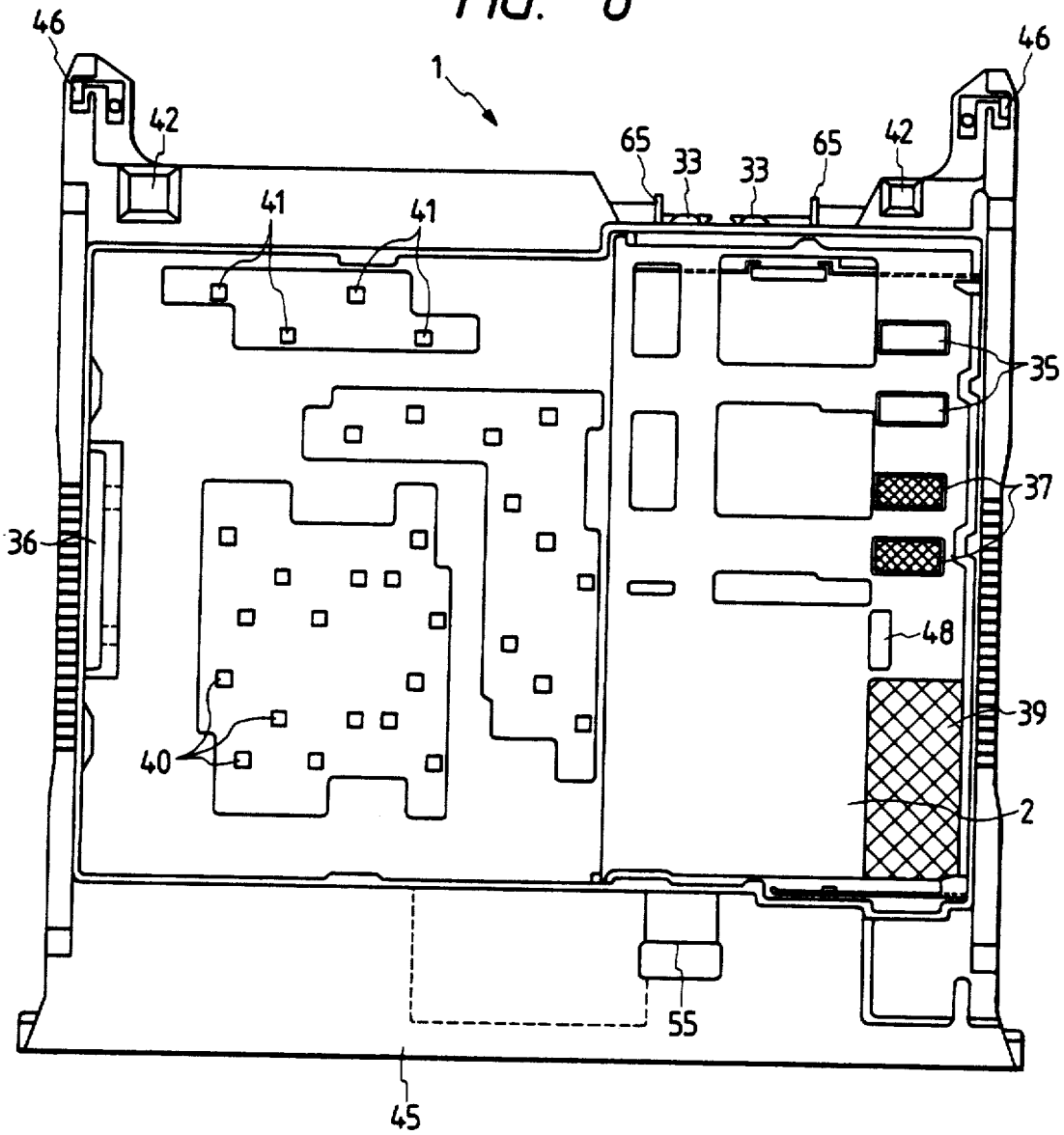
FIG. 6 is a plan view of the cassette.

Said auxiliary members 37 may have a metallic surface the same as that of the inner plate 2, or may be surfacially covered with a material of high friction as shown in FIGS. 6 and 10B. The latter structure is effective for preventing overlapped feeding when the number of remaining sheets decreases, particularly to two. In FIG. 6, a frictional member 39 is adhered to the inner plate 2, in a position opposite to the rollers.

The cassette shown in FIG. 6 is different from the one in FIG. 5 in that the former has six sheet feed rollers. Other structures are the same in both cassettes, so that no distinction will be made in the following description.

In the cassette 1, as shown in FIGS. 11A, 11B, 5 and 6, sheet size detecting blocks 33 are detachably mounted in the rear side in the inserting direction of the cassette. Said blocks 33 are to actuate sheet size detecting switch (not shown) provided in the body 11, and are changeable in position according to the sheet size.

Figure 12A:
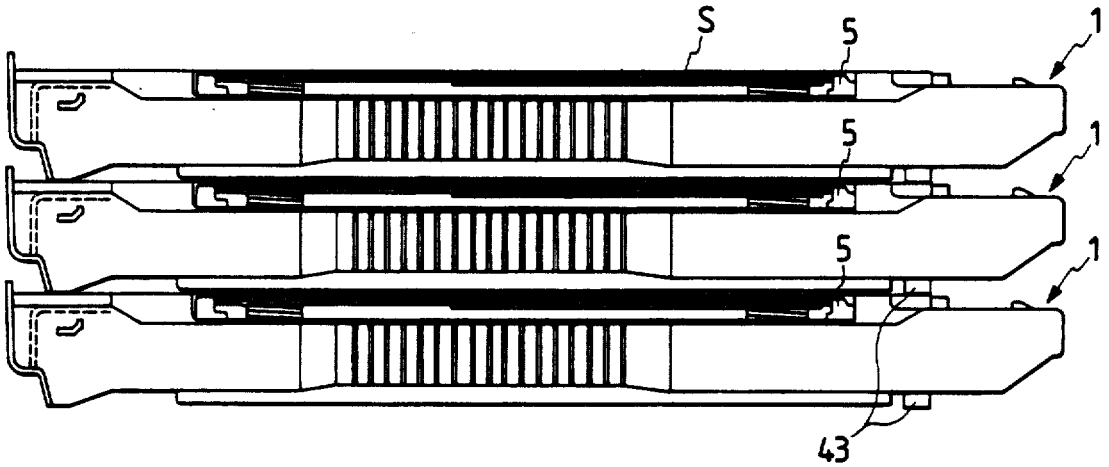
FIG. 12A is an elevation view of stacked cassettes.
Figure 12B:
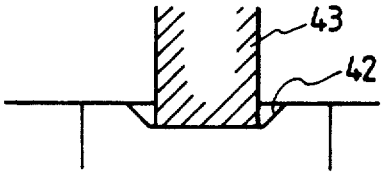
FIG. 12B is a magnified view of a fitting portion thereof.

Also, as shown in FIGS. 12A and 12B, recesses 42 are formed on the upper face in the rear portion of each cassette, and projections 43 are formed on the lower side in the rear portion for engaging with said recesses 42 to define the position of the cassettes when they are mutually stacked. Furthermore, a catch 44 (FIG. 3) is formed on the front face of the cassette 1, and catches 45 (FIG. 3) are formed on both lateral faces thereof for use in lifting the cassette 1.

Figure 7:
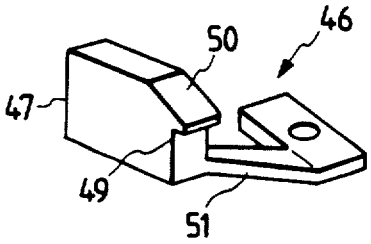
FIG. 7 is a partial magnified perspective view of said cassette.

As shown in FIG. 6, at the rear ends of the cassette 1 on both sides there are provided stoppers 46 of a resinous material, composed of a stopper receiver portion 47, a step portion 49, a sloped portion 50 and a spring portion 51 (cf. FIG. 7). Said stopper 46 has such projecting length and elasticity that, when the cassette 1 is loaded on the body 11, it becomes coplanar with the upper face of said cassette 1 by elastic deformation. In FIG. 6 there is further shown a sheet detecting hole 48.

Figure 13A:
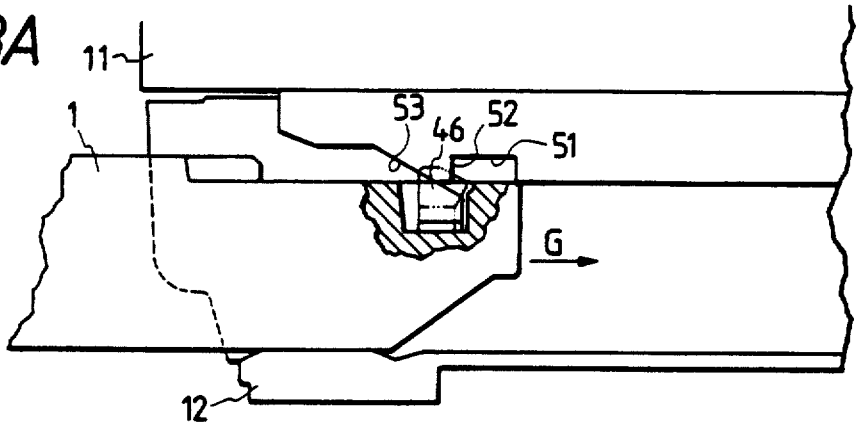
FIGS. 13A, 13B and 13C are elevation views showing the procedure of loading or detaching of the cassette into or from the image forming apparatus.

Above the loading portion for the cassette 1 in said body 1, there are provided, as shown in FIG. 13A, grooves 51 for fitting with said stoppers 46, step portions 52 for engaging with said stoppers 46 and sloped faces 53 in front of said step portions 52.

Figure 14:
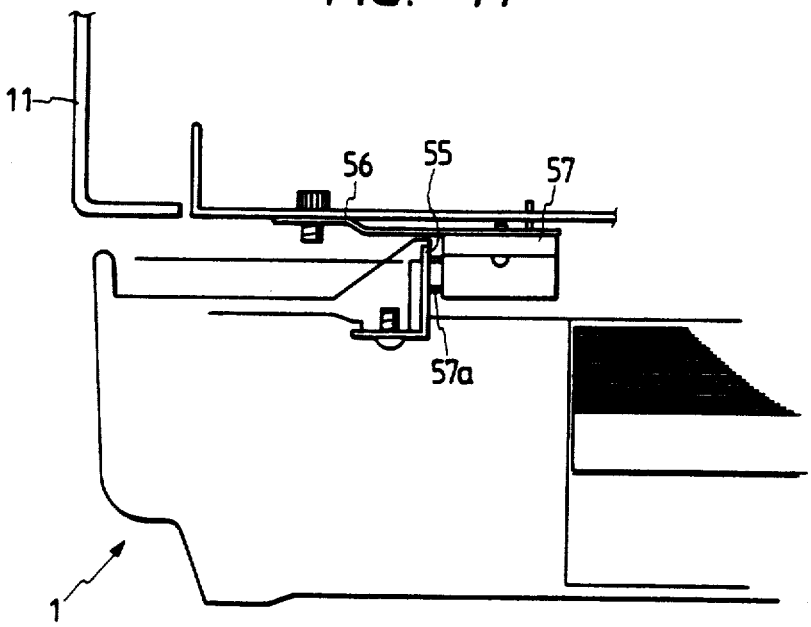
FIG. 14 is an elevation view showing means for positioning the cassette in the image forming apparatus.

In the approximate center of the front face of the cassette 1 there is provided, as shown in FIG. 14, a positioning plate 55 fixed for example with screws, and said positioning plate 55 is to be attracted by a position defining piece 57*a* of a magnet catch 57 mounted on the body 11 through a mounting plate 56. Said mounting plate 56 is made adjustable in position by several millimeters with respect to the body 11, so that the position of said magnet catch 57 can be regulated.

Figure 11A:
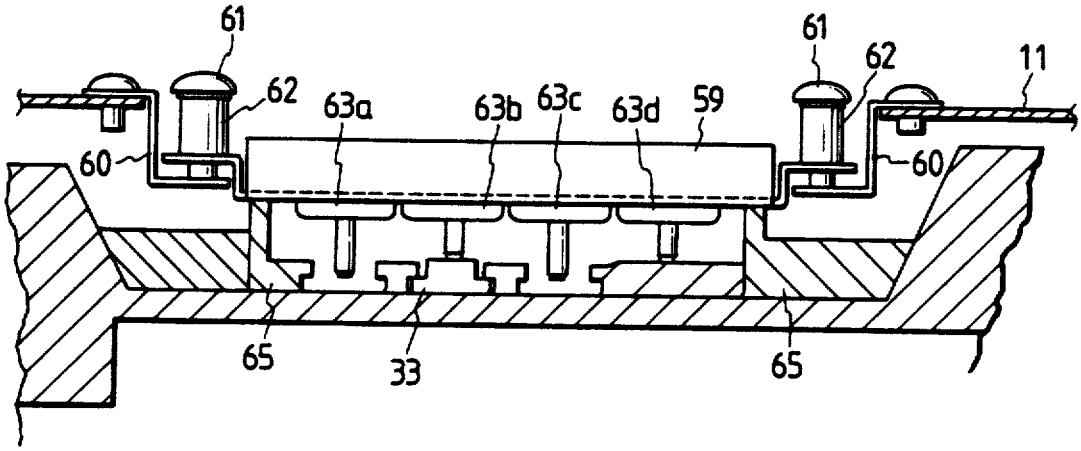
FIG. 11A is a magnified cross-sectional view of a loading portion, for the sheet storage device, of the image forming apparatus.
Figure 11B:
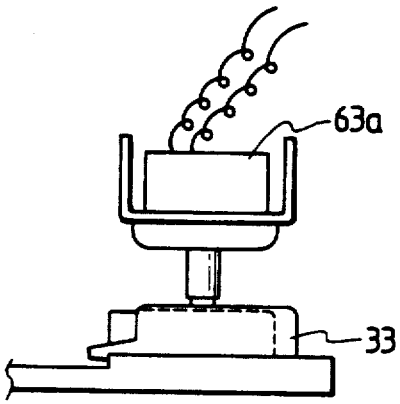
FIG. 11B is a partial magnified view thereof.

Also in a portion of said body 11 opposed to the aforementioned blocks 33, there is provided a mounting plate 59 as shown in FIGS. 11A and 11B. Said mounting plate 59 is slidably supported by pins 61 with enlarged heads fixed on brackets 60 mounted on the body 11, and springs 62 are provided between the head portions of said pins 61 and the mounting plate 59. On said mounting plate 59 there are mounted switches 63*a*, 63*b* and 63*c* for detecting the sheet size according to the positions of the blocks 33, and a switch 63*d* for detecting the presence of the cassette 1. On said cassette 1 there are provided, on both sides of said switches, projections 65 for defining the distance between said mounting plate 59 and the cassette 1.

In a part of the body 11 above the cassette 1 there is mounted a transmission-type sheet sensor 67 by means of a mounting plate 66. A shaft 69 is supported by an unrepresented frame in the vicinity of said sensor 67. Said shaft 69 rotatably supports a sensor lever 70 which is, at an end thereof, wide and L-shaped when seen from the side, and the other end of said sensor lever 70 supports a very light detection roller 71 rotatably in the direction of cassette loading and detaching. Behind said recesses 35 there is provided a receiving member 68 for uniformly transmitting the force of the springs 9, 9*a* and 9*b* to the inner plate 2. Said springs 9*a* and 9*b* are so constructed as to be integrally movable with the limiting plate 3.

Figure 16A:
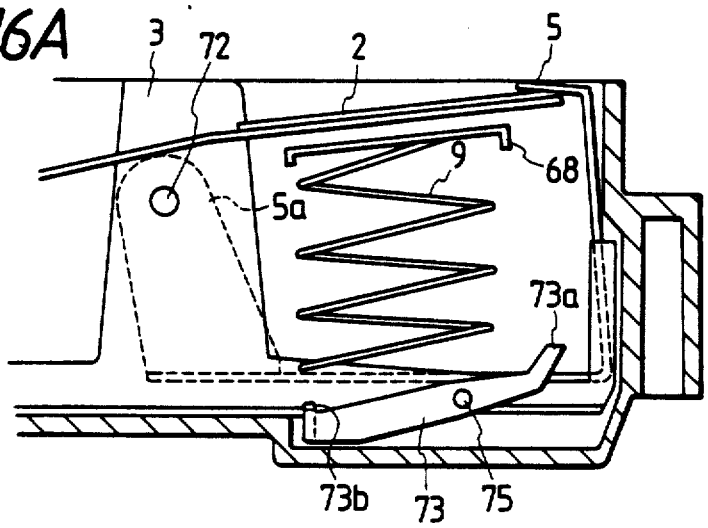
FIGS. 16A and 16B are frontal cross-sectional views showing the movement of upper and lower mechanisms of the separating finger of the cassette.
Figure 16B:
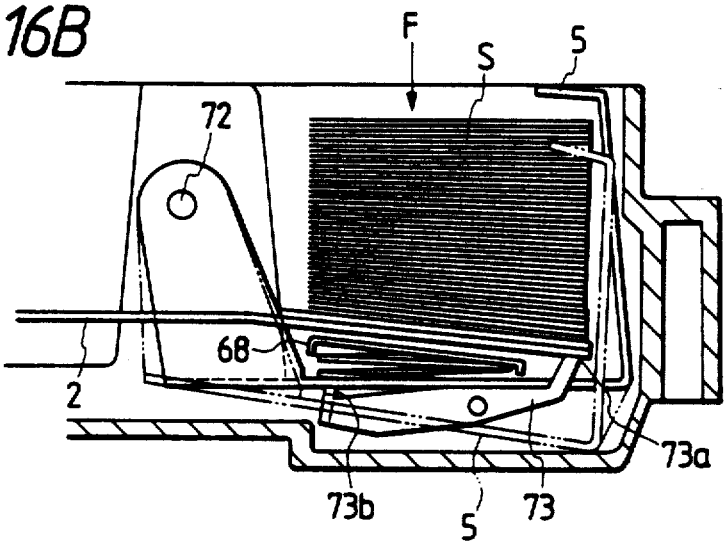

As shown in FIGS. 16A and 16B, the separating finger 5 is square-U shaped when seen from the front, and an end 5a thereof is rotatably supported by a shaft 72 provided on the cassette 1. Under said separating finger 5, a link lever 73 is rotatably supported by a shaft 75 fixed on the cassette, and an end 73a of said lever 73 is in contact with the inner plate supporting the stacked sheets S to rotate said lever 73 clockwise (in FIG. 16A), whereby the other end 73b biases the separating finger 5 counterclockwise.

In the following there will be explained the operation and function of the sheet feeding device of the present invention described above.

In the case of placing sheets S of the maximum size (width D in FIG. 8) in the cassette 1 and loading the same into the copying machine 10, the operator moves the limiting plate 3 to the left-end position of the cassette (indicated by the double-dotted line in FIG. 5) and fits the auxiliary members 37 in the recesses 35 corresponding to the sheet feed rollers 7a, 7b.

On the other hand, in the case of placing sheets S of a medium size (for example a width E) in the cassette 1, the operator moves the limiting plate 3 to the elongated holes 4 at the left side corresponding to the width of the sheets, fits the auxiliary member 37 only in the recess 35 corresponding to the feed roller 7b, and removes the auxiliary member 37 from the recess corresponding to the feed roller 7a (see FIG. 8).

Also, in the in case of placing the sheets S of the minimum size (width C in FIG. 8) in the cassette 1, the operator moves the limiting plate 3 to the elongated holes 4 close to the center (the solid-lined position in FIG. 5) and removes the auxiliary members 37 from both recesses 35.

In the foregoing it is assumed that the cassette is regulated or adjusted whenever the sheet size is changed, but it is naturally possible to provide an already regulated exclusive cassette for each sheet size.

Thus, when a plurality of maximum-sized sheets S are stacked on the inner plate 2 of the cassette 1, the inner plate 2 descends by the weight of said sheets S, against the force of the springs 9, 9a and 9b. In a case of stacking the sheets to the full capacity, the operator places the sheets S of a corresponding number on the inner plate 2, and pushes said sheets S in a direction F (FIG. 16B) against the function of the springs 9, 9a and 9b. Together with said sheets S, the inner plate is pushed down in the direction F and contacts an end 73a of the lever 73, thereby rotating the same clockwise. In response the other end 73b of said lever contacts the separating finger 5 to rotate the same counterclockwise. Thus, said separating finger 5 moves from the double-dotted line position to the solid line position (FIG. 16B) and the end thereof is pushed upward beyond the uppermost surface of the sheets S. The operator moves the sheets S in the transporting direction until the end portion of the sheets S comes under the end of the separating finger 5 and removes the pressing force in the direction F, whereby the inner plate 2 and the sheets S are biased upwards by the springs 9. Thus the uppermost sheet S is positioned in contact with the end of the separating fingers 5. In this state, the biasing force of the springs 9 in the position of the recesses 35 is uniformly transmitted, by means of the receiving member 68, to the inner plate 2. Also in this state the end 73a of the link lever 73 is not in contact with the inner plate, and the other end 73b is not in contact with the separating fingers 5, so that the link lever 73 does not affect the inner plate 2 and the separating fingers. The sheets S are prevented from the lateral movement by the limiting plate 3 and the side plate 8, from the movement in the transporting direction by the separating fingers 5, and from the rearward movement by the limiting plate 36.

Figure 13B:
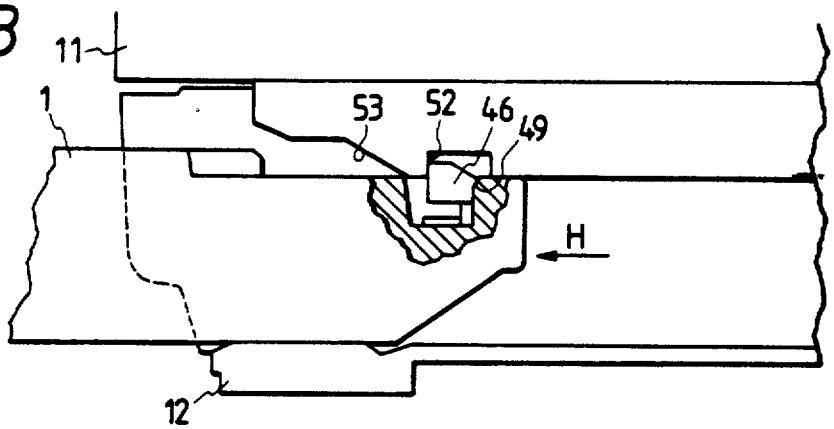
Figure 13C:
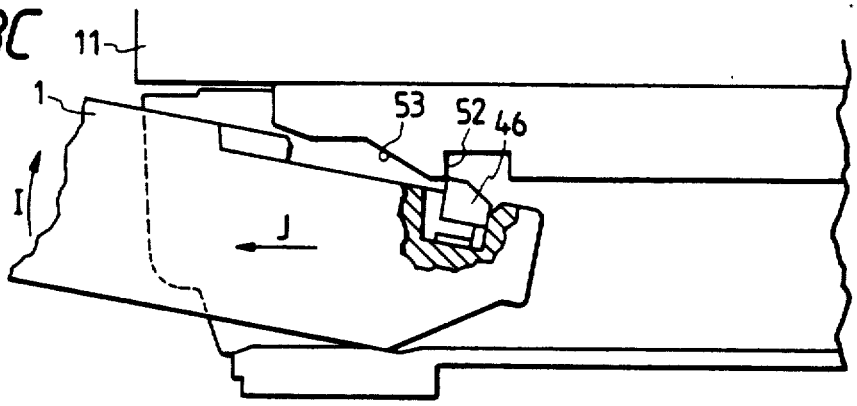

In loading the cassette 1 filled with the sheets S into the body 11, the operator pushes in the cassette 1 in a direction G (FIG. 13A) with the rear portion thereon on the guides 12, whereby the upper portions of the stoppers 46 is deformed by contact with the sloped faces 53 provided in the body 11 and become coplanar with the upper face of the cassette 1. After passing the stepped portions 52, the stoppers 46 resume the original form, whereby said stoppers 46 and said stepped portions 52 mutually engage and the step portions 49 (FIG. 7) are in contact with the cassette itself to prevent deformation. The cassette 1 is therefore not easily extractable in a direction H (FIG. 13B). If such extraction becomes necessary, the cassette 1 is shifted in a direction I (FIG. 13C) to position the lower end of the cassette 1 away from the guides 12, and is extracted in a direction J when the stoppers 46 become lower than the step portions 52 of the body 11.

When the cassette 1 is pushed into the body 11, the positioning plate 55 is attracted by the magnet catch 57 whereby the cassette 1 is properly positioned (FIG. 14). At the same time the positioning projections 65 at the rear side of the cassette 1 come into contact with the mounting plate 59, thereby moving said mounting plate 59 against the force of the springs 62 and maintaining a predetermined distance between the ends of the switches and the cassette 1. The block 33 turns on one of the sheet size detecting switches 63a, 63b and 63c, for example the switch 63b, while the cassette 1 turns on the cassette detecting switch 63d, and the signals from said switches 63b, 63d are transmitted to the control unit. Also in response to the loading of the cassette 1, the detecting roller 71 is moved, by the sheets S contained in the cassette 1, from the solid-lined position to the double-dotted line position (FIG. 15), whereby the end 70a of the sensor lever 70 intercepts the light path between a light-emitting portion and a light-receiving portion of the sheet sensor 67, thereby turning off the same. In response to an off signal from said sensor 67, the control unit discriminates the presence of the sheet S in the cassette 1. Upon loading of the cassette 1 in the body 11, the sheets S are pressed against the sheet feed rollers 7a, 7b and 7 by means of the inner plate 2 and the auxiliary members 37, which are biased upwards by the springs 9.

When the start key is depressed after an original document is placed on the platen 15, the image of said original is read by means of the lamp 16, mirrors 17, 18, 19, 20, 21 and 22 and lens 23 and a copied image is formed in the image forming station 27. On the other hand, the sheets S are separated by the sheet feed rollers 7 and the separating fingers 7 in the cassette 1, and the uppermost sheet alone is fed. Said sheet S is transported by the transport rollers 25 to the nip of the registration rollers 26, and is further given a transporting force by the slipping transport rollers 25 for correcting the skewed advancement. Said registration rollers 26 are activated at a predetermined timing to advance said sheet S in synchronization with the image formed in the image forming station 27. After image transfer in the image forming station 27, the sheet S is transported, by the conveyor belt 29, to the fixing unit 30, and, after image fixation therein, it is discharged, by the discharge rollers 31, to the sheet tray 32.

Figure 15:
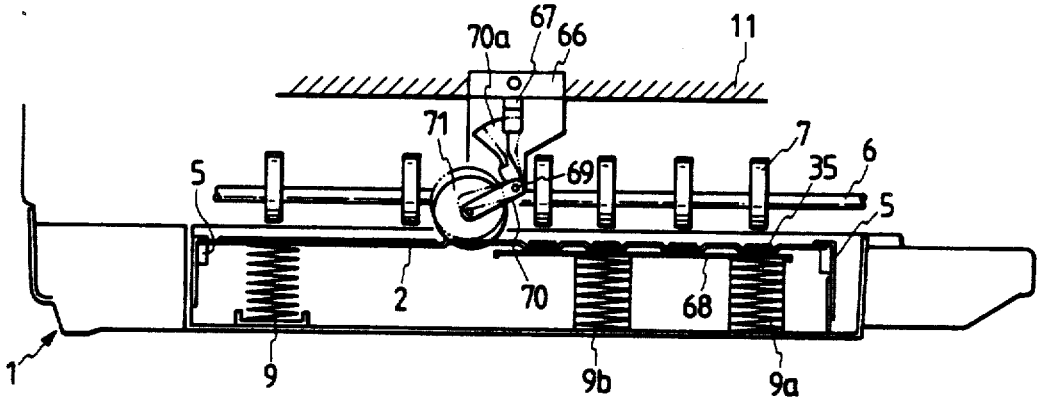
FIG. 15 is a lateral cross-sectional view showing means for detecting the presence or absence of sheets in the cassette.

When the sheets S in the cassette 1 are exhausted, the detecting roller 71 falls into the hole 48, thus moving from the double-dotted line position to the solid-lined position shown in FIG. 15. Consequently, the end 70*a* of the sensor lever 70 also moves from the double-dotted line position intercepting the light path of the sheet sensor 67 to the non-intercepting solid-lined position, thereby turning on said sensor. In response to the on signal from the sensor 67, the control unit discriminates the absence of sheets S in the cassette 1 and gives an alarm on a display unit. Recognizing said alarm, the operator extracts the cassette 1, replenishes the cassette 1 with the sheets S in the aforementioned procedure, and reloads said cassette 1 in the body 11.

In case of stacking plural cassettes 1 outside the body 11 of the copying machine 10, the operator fits the lower projections 43 of an upper cassette into the upper recesses 42 of a lower cassette. In this manner, plural cassettes can be stacked without contact between the lower face of a cassette with the upper face of a lower cassette (FIGS. 12A, 12B).

Figure 17:
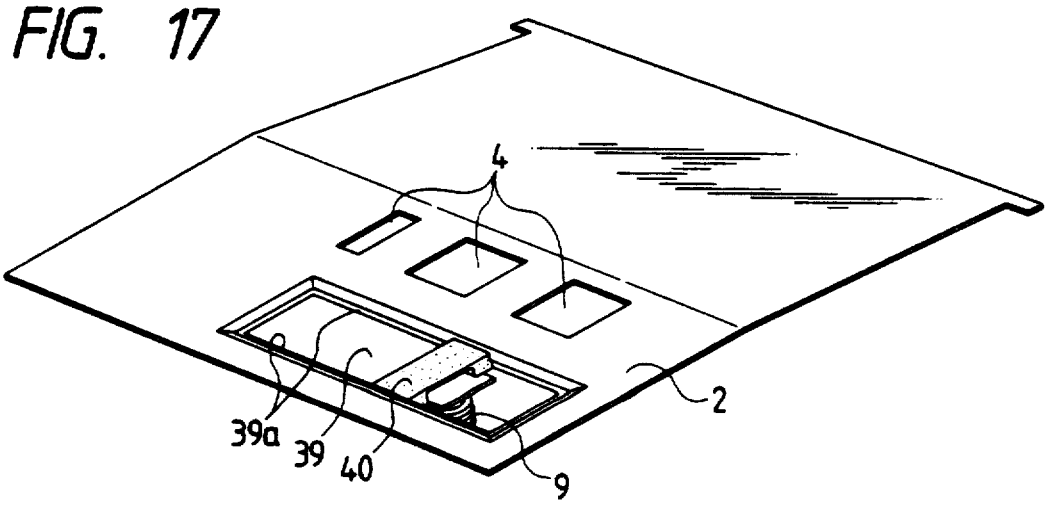
FIG. 17 is a perspective view of another embodiment of the auxiliary member of the inner plate.

The present invention is naturally not limited to the foregoing embodiment. For example, FIG. 17 shows another embodiment in which the inner plate 2 is provided with an elongated aperture as an escape.

The inner plate 2 is provided with an elongated aperture 39 in a position corresponding to the sheet feed rollers 7*a*, 7*b*, and the front and rear edges of said aperture 39 constitute rails 39*a*, which laterally slidably support an auxiliary member 40. Said auxiliary member 40 can be moved to a position corresponding to the sheet feed rollers 7*a* and 7*b* when the sheet covers these rollers, and is fixed at such position for example by a lock mechanism, thereby serving to press the sheets S against the sheet feed rollers 7*a* and 7*b*. Said auxiliary member can be placed at an escape position at the right-hand end in FIG. 17 when it need not be positioned facing the feed rollers 7*a* and 7*b*. Such structure has an advantage of simpler operation.

Figure 18A:
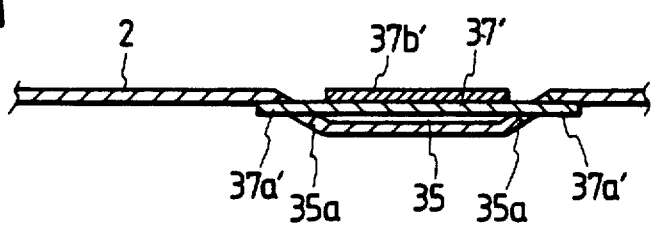
FIGS. 18A and 18B are frontal cross-sectional views of still another embodiment of the auxiliary member of the inner plate.
Figure 18B:
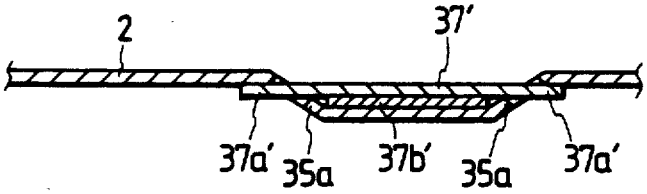
Figure 19A:
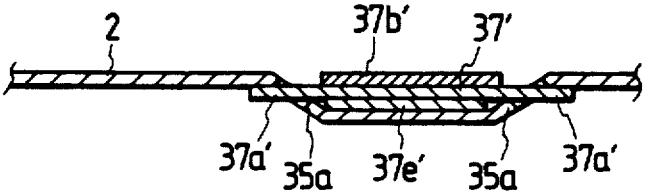
FIGS. 19A and 19B are frontal cross-sectional views of still another embodiment.
Figure 19B:
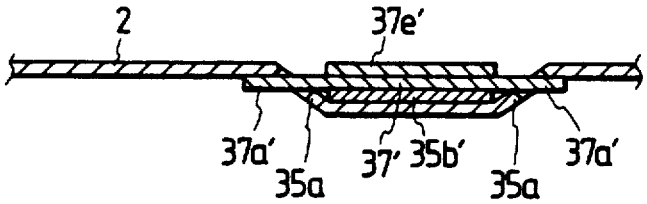

Also, as shown in FIGS. 19A and 19B, the auxiliary member 37' may be constructed reversible, with a face formed with a high friction material 37*b*' and the other face formed with a low friction material 37*e*'. Also as shown in FIGS. 18A and 18B, it is possible to form the high friction material only on one face and to form the other face in such a manner that said other face is retracted from the inner plate 2 when said face is fitted upwards. Such auxiliary member does not pose the risk of losing it since it need not be removed from the cassette but need simply be reversed.

As to the mode of use of the cassette, there may be prepared plural cassettes respectively exclusive for different sizes, for an image forming apparatus. Otherwise, there may be employed only one cassette for an image forming apparatus and the limiting plate may be moved for each change of the sheet size.

What is claimed is:

1. A sheet feeding device for use in an image forming apparatus provided with plural rotary members arranged respectively at a position opposed to a small sized sheet and at a position opposed to a large sized sheet, side by side axially, for separating and feeding the sheets supported on a sheet support plate, said sheet feeding device comprising:

a sheet support plate for supporting the sheets;

a recessed portion formed on said sheet support plate in a position to the rotary member which is at the position opposed to the large sized sheet;

a detachable auxiliary friction member for said sheet support plate, to be fitted in said recessed portion for forming a plane in feeding the large sized sheet and to be removed from said recessed portion in feeding the small sized sheet; and a friction member on said sheet support plate in a position opposed to the rotary member which is at the position opposed to the small sized sheet.

2. A sheet feeding device for use in an image forming apparatus, provided with plural rotary members arranged respectively at a position opposed to a small sized sheet and at a position opposed to a large sized sheet, side by side axially, for separating and feeding the sheets supported on a sheet support plate, said sheet feeding device comprising:

a sheet support plate for supporting the sheets thereon;

a recessed portion formed on said sheet support plate in a position opposed to the rotary member which is at the position opposed to the large sized sheet;

a detachable auxiliary friction member for said sheet support plate to be fitted in said recessed portion for forming a plane; and a friction member on said sheet support plate in a position opposed to the rotary member which is at the position opposed to the small sized sheet, wherein said auxiliary friction member for said sheet support plate is reversibly fittable in said recessed portion, and is provided with a friction member on the top face thereof and a member of a lower friction coefficient than that of said friction member on the rear face thereof.

3. A sheet feeding device for use in an image forming apparatus provided with a plurality rotary members arranged respectively at a position opposed to a small sized sheet and at a position opposed to a large size sheet, side by side axially, for separating and feeding sheets supported on a sheet support plate; said sheet feeding device comprising:

a sheet support plate for supporting the sheets thereon;

a recessed portion formed on said sheet support plate in a position opposed to the rotary member which is at the position opposed to the large sized sheet;

a detachable auxiliary friction member for said sheet support plate to be fitted in said recessed portion for forming a plane; and a friction member on said sheet support plate in a position opposed to the rotary member which is at the position opposed to the small sized sheet, wherein said auxiliary friction member for said sheet support plate is reversibly fittable in said recessed portion, and is provided with a friction member on the top face thereof and the rear face thereof is not limited in its constituting material but is so constructed as to be lower than the surface of said sheet support plate when fitted.

4. A sheet feeding device according to claim 1, 2 or 3, further comprising a lateral sheet guide member movable corresponding to the positions of said divided rotary members.

5. A sheet storage device provided with a sheet support plate for supporting sheets thereon and to be loaded in an image forming apparatus having plural rotary members arranged respectively at positions opposed to a small sized sheet and to a large sized sheet, side by side axially, for separating and feeding the sheets supported on said sheet support plate, said sheet feeding device further comprising:

a recessed portion formed on said sheet support plate in a front end side in the sheet feed direction and in a position opposed to the rotary member which is at the position opposed to the large sized sheet; and a detachable auxiliary friction member for said sheet support plate adapted to be fitted in said recessed portion for forming a plane in receiving the large sized sheet and to be removed from said recessed portion in receiving the small sized sheet.

6. A sheet storage device according to claim 5, wherein said device constitutes a cassette.

7. A sheet storage device according to claim 6, wherein said device is a cassette of front loading type, which is loaded or detached in a direction perpendicular to the sheet feed direction.

8. A sheet storage device according to claim 7, further comprising engaging means for engaging with a step portion formed in a cassette housing portion of the image forming apparatus, whereby at the extraction of said cassette, said engaging means engage with said step portion when the cassette is almost entirely extracted, thereby prohibiting further extraction.

9. A sheet storage device according to claim 8, wherein said engaging means is composed of an elastic part and an engaging part which are integrally molded.

10. A sheet feeding device for an image forming apparatus provided plural rotary members arranged respectively at a position opposed to a small sized sheet and at a position opposed to large sized sheet, side by side axially, for separating and feeding sheets supported on a sheet support plate, said sheet feeding device comprising:

a sheet support plate for supporting sheets thereon;

a recessed portion formed on said sheet support plate in a position opposed to the rotary member which is at the position opposed to the large sized sheet;

a detachable auxiliary friction member for said sheet support plate, which is movable in the axial direction of the rotary members and is fittable in said recessed portion to form a plane in said recessed portion coplanar with the surface of said sheet support plate; and a friction member on said sheet support plate in a position opposed to the rotary member which is at the position opposed to the small sized sheet.

* * * * *

UNITED STATES PATENT AND TRADEMARK OFFICE

CERTIFICATE OF CORRECTION

PATENT NO. : 4,995,601

DATED : February 26, 1991

INVENTOR(S) : MASASHI OHASHI ET AL.

It is certified that error appears in the above-identified patent and that said Letters Patent is hereby corrected as shown below:

COLUMN 1

Line 16, "is provided therein with" should read --is already known an image forming apparatus provided with--.

Line 54, "overlapped or" should read --overlapped feeding, or--.

COLUMN 2

Line 21, "contact or" should read --contact, or--.

COLUMN 4

Line 28, "body 1," should read --body 11,--.

COLUMN 5

Line 29, "in" (second occurrence) should be deleted and "the" (second occurrence) should be deleted.

COLUMN 6

Line 58, "separating fingers 7" should read -- separating fingers 5--.

UNITED STATES PATENT AND TRADEMARK OFFICE

CERTIFICATE OF CORRECTION

PATENT NO. : 4,995,601

DATED : February 26, 1991

INVENTOR(S) : MASASHI OHASHI ET AL.

It is certified that error appears in the above-identified patent and that said Letters Patent is hereby corrected as shown below:

COLUMN 8

Line 2, "position to" should read --position opposed to--.
Line 37, "a plurality" should read --plural--.
Line 39, "size" should read --sized--.

COLUMN 10

Line 7, "provided" should read --provided with--.

Signed and Sealed this

Nineteenth Day of January, 1993

*Attest:*

*Attesting Officer*

DOUGLAS B. COMER

*Acting Commissioner of Patents and Trademarks*